US005287895A

United States Patent [19]

Raaijmakers et al.

[11] Patent Number: 5,287,895

[45] Date of Patent: Feb. 22, 1994

[54] EQUIPMENT FOR TRANSPORTING AND HANDLING WEFT-YARN STOCK BOBBINS

[75] Inventors: Tonny Raaijmakers, Winterthur, Switzerland; Gregor Gebald, Mönchengladbach, Fed. Rep. of Germany; Manfred Langen, Mönchengladbach, Fed. Rep. of Germany; Helmut Bungter, Viersen, Fed. Rep. of Germany; Hans-Peter Schmitz, Mönchengladbach, Fed. Rep. of Germany

[73] Assignee: Sulzer Brothers Limited, Winterthur, Switzerland

[21] Appl. No.: 871,522

[22] Filed: Apr. 20, 1992

[30] Foreign Application Priority Data

May 15, 1991 [CH] Switzerland ..... 01455/91

[51] Int. Cl.[5] ..... D03D 47/00

[52] U.S. Cl. ..... 139/1 R; 242/35.5 A; 139/450; 414/222; 414/908; 104/91

[58] Field of Search ..... 57/281; 242/35.5 A; 139/1 R, 224 R, 224 A, 450; 414/908, 222; 198/465.2, 580; 104/91

[56] References Cited

U.S. PATENT DOCUMENTS 3,884,026 5/1975 Yoshizawa et al. ..... 57/281
4,846,618 7/1989 Matsui ..... 242/35.5 A X
4,970,856 11/1990 Taniguchi et al. ..... 242/35.5 A X
5,003,762 4/1991 Scaglia ..... 57/281
5,148,665 9/1992 Kidani ..... 57/281

*Primary Examiner*—Andrew M. Falik
*Attorney, Agent, or Firm*—Townsend and Townsend Khourie and Crew

[57] ABSTRACT

An equipment for transporting, handling and feeding stock bobbins to a loom having a preparation station (5) for the charging of bobbin holders (12) with stock bobbins (4) and a transport loop (7) for transporting these bobbin holders (12) towards looms. The looms are arranged in groups and for returning bobbin holders (12') containing empty bobbin tubes towards the preparation station (5), as well as at least one storage section (7c) branching off the transport loop (7) for receiving a number of the bobbin holders (12, 12') which corresponds with the need of bobbins at the time by at least one of the groups of looms (1a, 1b, . . . 1n). For the exchange of the bobbin holders (12' or 12 respectively) on the looms a loading mechanism (18) is provided which is mounted on a secondary transport mechanism (10) which may be moved independently of the transport loop (7) towards a number of groups of looms (1a, 1b, . . . 1n) and is intended for temporarily receiving the bobbin holders (12, 12') which may be fed from and returned to the storage section (7c). Through this execution a simple clearly arranged method of construction of the equipment is achieved, which makes possible a loading of the looms with stock bobbins to match the needs, which may be automated in a simple manner.

8 Claims, 6 Drawing Sheets

Fig.5
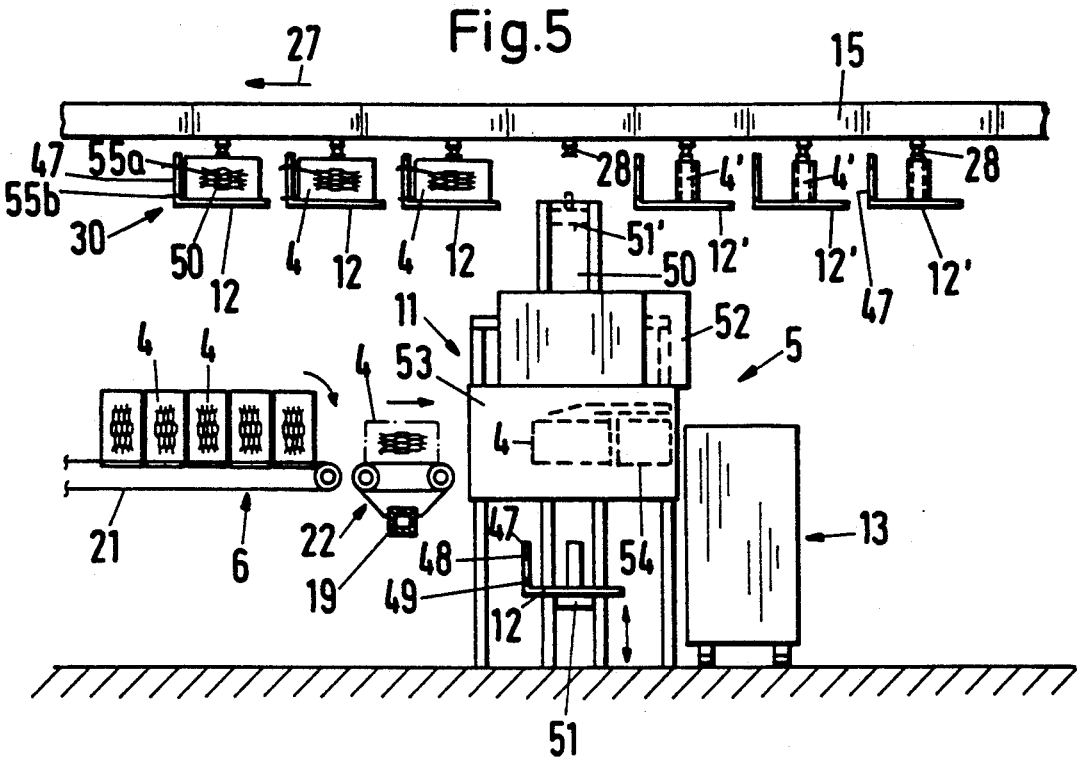
Fig.6
Fig.7
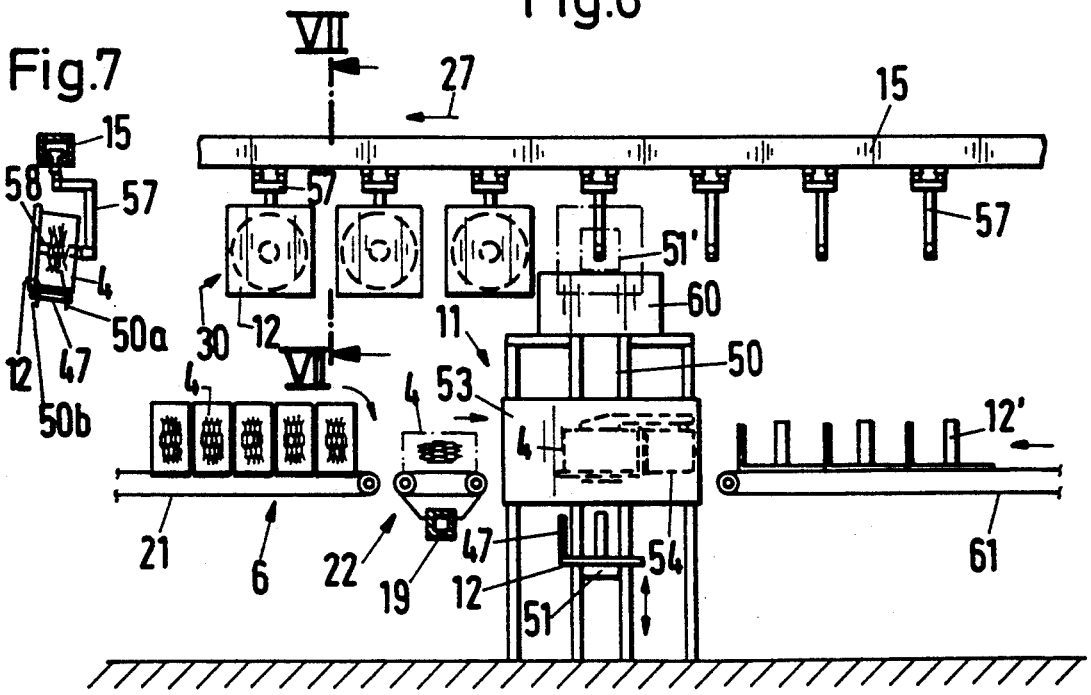

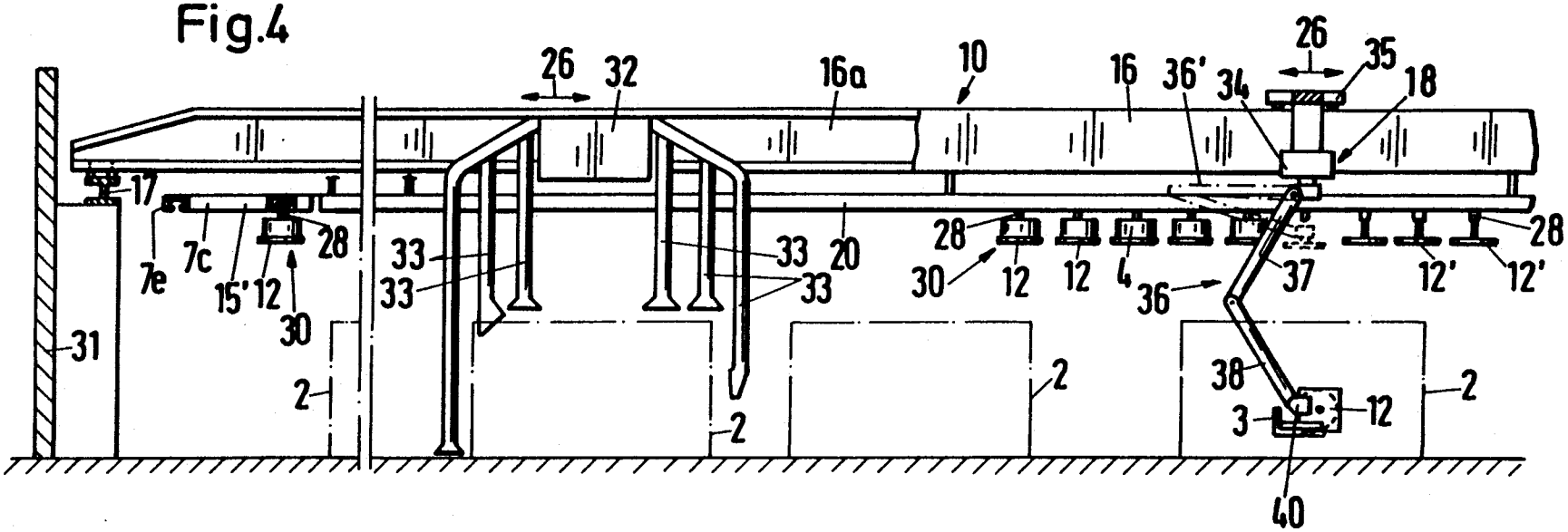
Fig.4
Fig.8
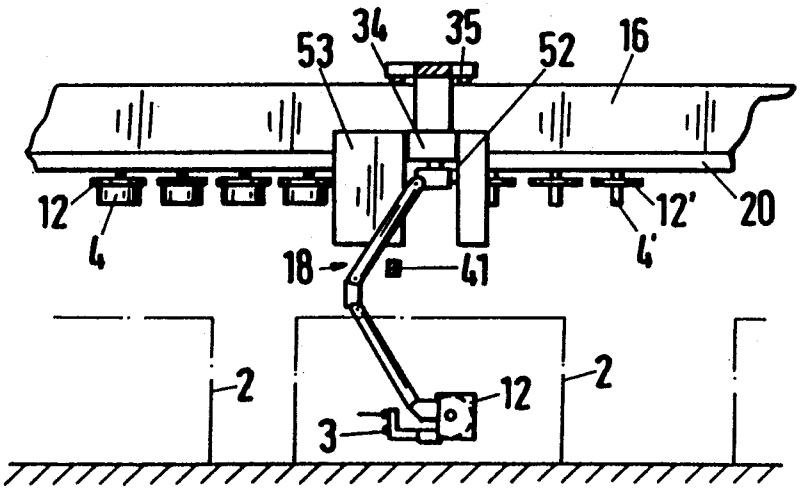

EQUIPMENT FOR TRANSPORTING AND HANDLING WEFT-YARN STOCK BOBBINS

BACKGROUND OF THE INVENTION

The invention is concerned with an equipment for transporting and handling weft-yarn stock bobbins as well as for feeding them to bobbin frames on looms and for carrying away empty bobbin tubes from the bobbin frames.

The invention is further concerned with a method of operation of the equipment.

In the case of an equipment of the aforesaid kind known from the DE-OS 34 13 681, bobbin holders charged with stock bobbins and bobbin tubes are arranged in a closed transport loop which is led by one transport section along the bobbin frames of one group of looms arranged in a row, one storage section branching off from this transport section being associated with each of the looms. When all of the storage sections have been filled with a predetermined number of charged bobbin holders, access to the storage sections from the transport section beside the looms is blocked, whereupon further bobbin holders charged with stock bobbins and lying in the transport section beside the looms, circulate in a constant rotation round the transport loop without being brought into the storage section. Accordingly, in the case of the known equipment, a relatively large number of stock bobbins is in rotation at any time. In the case of an equipment of that kind in which under certain circumstances stock bobbins run round a number of times, the risk exists that the bobbins, in particular the turns of yarn wound onto them, will be damaged and/or soiled. In the case of the known arrangement with the storage sections associated one per loom, a feed of stock bobbins wound with different kinds of yarn to match the needs of individual looms, especially in the case of multicolour weaving operation, demands a relatively elaborate loom-related planning in order to place ready in the individual storage sections a combination of the different stock bobbins to correspond with the need of bobbins at the time, since correction of the preselected sequence of bobbins is not possible. In the case of installations having a number of groups of looms arranged in rows, the known arrangement would demand a relatively elaborate transport system in which one transport section in constant rotation, with a number of storage sections associated one per loom, is associated with each of the groups of looms.

The problem underlying the invention is to create an equipment of the kind, which is improved in this respect, is simple to operate, takes good care of the stock bobbins ,and is of simplified construction as compared with known devices, and which though needing relatively little room enables loading of the looms with stock bobbins to match their needs and may be automated in a simple way.

SUMMARY OF THE INVENTION

This problem is solved in accordance with the invention which include a transport loop having a storage section connected to a portion of the transport loop intended for loading a number of groups of looms arranged in parallel rows. The storage section is constructed for receiving a number of bobbin holders to correspond with the bobbins needed by the looms of at least one of the groups of looms. A secondary transport mechanism is provided, which may be moved independently of the transport loop towards a number of groups of looms and is intended for receiving temporarily at any time at least one of the bobbin holders which may be fed from the storage section and returned to it, and that the loading mechanism is fitted to this transport mechanism in such a way that it may be adjusted in relation to the looms of the group of looms and fixed in loading positions associated with the respective looms.

The method in accordance with the invention includes the steps of charging, in a preparation station, a predetermined number of bobbin holders with stock bobbins made ready to correspond with the need of bobbins of one of the groups of looms having to be loaded at the time. The bobbin holders are combined into one transport unit and brought via the transport loop into a waiting position provided in the storage portion. A secondary transport mechanism is brought into a transfer position associated with the storage portion. The secondary transport mechanism is moved into a transfer position associated with the looms of the predetermined group of looms, intermittently bringing the loading mechanism into a loading position which corresponds with the need of bobbins of the individual looms and in which the exchange of the bobbin holders of the stock bobbins or respectively of the bobbin tubes is effected. The bobbin holders charged with the bobbin tubes, and possibly with stock bobbins which have not been exchanged into the storage section, are carried and returned via the transport loop to the preparation station, recharging them to correspond with the need of bobbins of a further group of looms and one more feeding them to the storage section.

The equipment developed in accordance with the invention is distinguished by a clearly arranged construction of the transport system which, in particular, enables simple routing both of the transport loop running between the preparation station and the looms and of the additional transport mechanism.

The method of operation in accordance with the invention enables functional separation of the transport mechanism, which is able to move within the loom installation and is intended for loading the individual groups of looms, from the transport system, which is provided between the preparation station and the loom installation and is intended for feeding the number of stock bobbins necessary at any time. In this manner the device may be operated largely independently of influences on the part of the looms, in particular independently of the loading process at any time.

Refinements of the invention are specified in the dependent claims.

Further details follow from the description below of embodiments of the invention represented diagrammatically in the drawing.

BRIEF DESCRIPTION OF THE DRAWING

FIG. 4 is a detail of the equipment according to FIG. 2 in a partial section;

FIG. 5 is a further detail of the equipment according to FIG. 2 in a side elevation in accordance with the arrow V in FIG. 2;

FIG. 6 is a detail of another embodiment in a side elevation corresponding with FIG. 5;

FIG. 7 is a section at VII—VII from FIG. 6;

FIG. 8 is a detail of a further embodiment in a partial section corresponding with FIG. 4;

DESCRIPTION OF THE PREFERRED EMBODIMENTS

Figure 1:
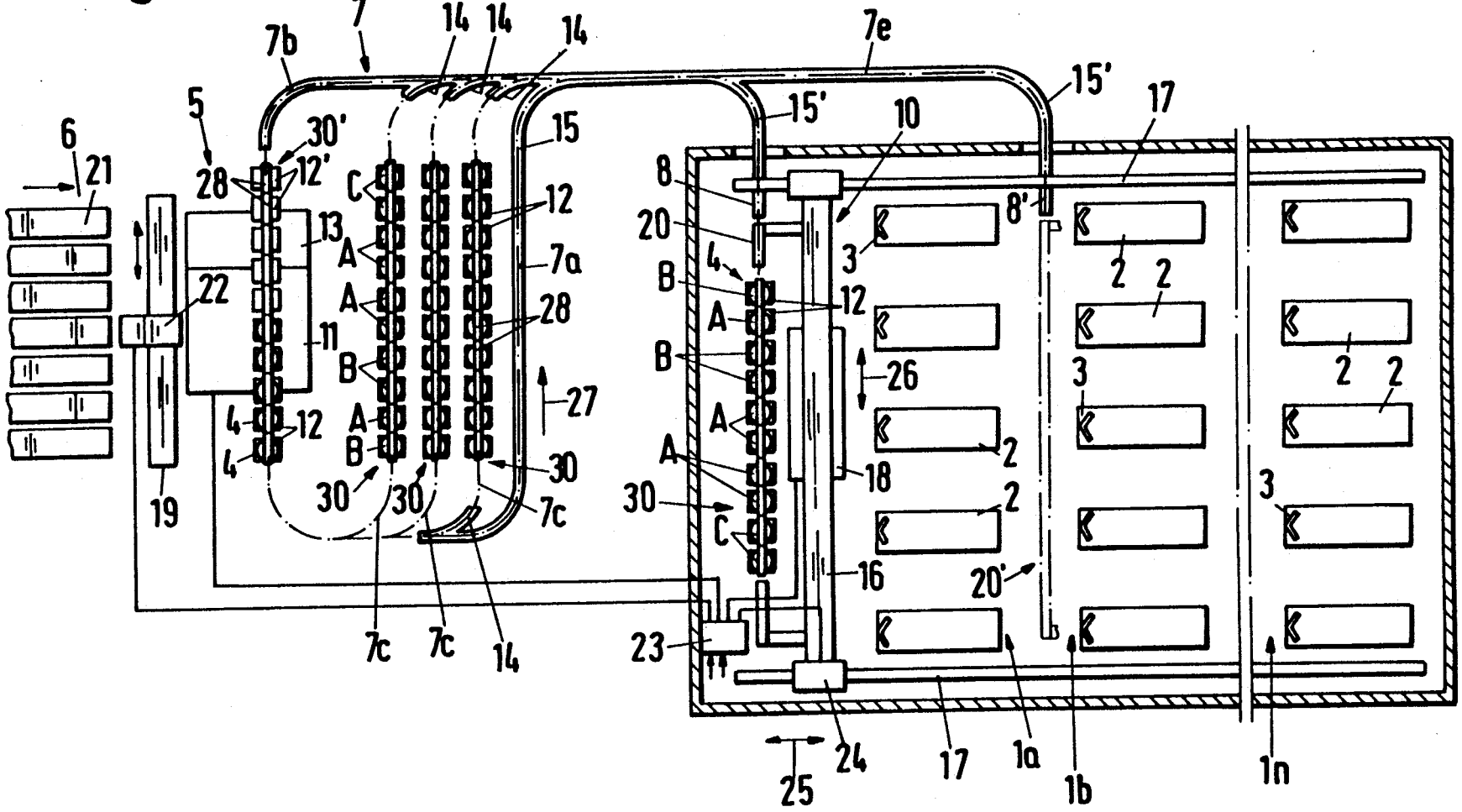
FIG. 1 - A loom installation with an equipment developed in accordance with the invention for the transport of weft-yarn stock bobbins and bobbin tubes, in a severely simplified partial plan.

The loom installation according to FIG. 1 contains a number of groups of looms 1*a*, 1*b* . . . 1*n* which are arranged in rows in a weaving shed and separated from one another by alleyways and each of which in accordance with the illustration exhibits five looms 2. In the simplified plan according to FIG. 1 each loom 2 is represented by a rectangular area which contains a bobbin frame 3 indicated at one narrow side for receiving at least two weft-yarn stock bobbins 4, one of which serves as the draw-off bobbin and the other as standby bobbin. Each stock bobbin 4 is fastened in a known manner to a mounting on the bobbin frame 3, while the piece at the start of a weft yarn wound onto the draw-off bobbin is fed to a weft insertion device and by a fluid weft insertion medium, e.g., compressed air, or a mechanical weft insertion member, e.g., a gripper belt, a gripper rod or a projectile, becomes inserted into the shed of the loom 2 in parallel with the long sides of the rectangular area. The piece at the start of the weft yarn on the standby bobbin may be connected in known manner to the end of the weft yarn on the draw-off bobbin.

Outside the weaving shed a preparation station 5 is provided for preparation of the wound stock bobbins 4 which are to be fed to the looms and which are carried from a winding or spinning installation and/or a bobbin store (not shown), via an assembly station 6 to the preparation station 5. Via a closed transport loop 7 which exhibits a feed section 7*a* running towards the weaving shed and a return section 7*b* running back towards the preparation station 5, the latter is connected to a number—two as illustrated—of junction sections 8 and 8'. The junction sections 8 and 8' are directed towards the range of movement of a secondary transport mechanism 10 associated with the groups of looms 1*a*, 1*b* . . . 1*n*. The preparation station 5 contains a station 11 for charging bobbin holders 12 which may be carried via the feed section 7*a* towards the looms 2, with a predetermined number of stock bobbins 4. The preparation station also includes a discharging station 13 for removing empty bobbin tubes 4' from corresponding bobbin holders 12' which may be carried via the return section 7*b* towards the preparation station 5.

In accordance with the illustration the transport loop 7 may be formed essentially by a circulating conveyor equipment which may exhibit a number—three as illustrated—of storage sections 7*c* arranged in parallel with one portion of the feed section 7*a*. Each storage section contains a number of groups of carriers 28 which are each connected to one conveyor chain and guided in guiderails 15. The guiderails 15 are arranged at a certain height above the floor and are executed in known manner with driving means, e.g., friction wheels for moving the carrier groups onwards and with branches (sidings) 14 off for passing in and out at option any one of the carrier groups to which the bobbin holders 12, 12' may be detachably fastened. Via this system of guiderails 15 the stock bobbins 12 may be carried on to the respective loom 2 at any time without disturbing the weaving operation.

The transport mechanism 10 comprises a supporting structure with a bearer rail 16 running in parallel with the alleyways in the form of a crane beam which in accordance with the illustration may extend across the width of the weaving shed and according to the arrows 25 is carried by a driving mechanism 24 along guideways 17 extending over the length of the weaving shed at the sides, so that it may be adjusted and fixed. But also a number of crane beams may be provided each running across one section of the width. A loading mechanism 18 is mounted on the bearer rail 16 so as to be able to shift according to the arrows 26 and may at any time be positioned with respect to the looms 2 in a position which allows an exchange of a bobbin holder 12' carrying an empty bobbin tube 4' for a bobbin holder 12 charged with a fully wound stock bobbin 4. A mounting 20 in the form of a piece of guiderail is further arranged in parallel with and fastened to the bearer rail 16, and may be brought together with the junction section 8 in a first transfer position and with the junction section 8' in a second transfer position 20', and receives the bobbin holders 12 which may be fed from any one of the storage sections 7*c*. The driving mechanism 24 and the loading mechanism 18 may be connected, each via a control equipment (not shown), to a master computer 23 which may be influenced in dependence upon control signals from sensors (not shown) which detect the need of bobbins by the individual looms 2.

The wound stock bobbins 4 coming from spinning or winding machines and/or a bobbin store are singled, provided if necessary with a code corresponding with the kinds of yarn and fed via the assembly station 6 to the preparation station 5. The assembly station 6 may contain a number, seven in accordance with FIG. 1, of conveyor belts 21 for feeding stock bobbins 4 separated according to the kinds of yarn and means of selecting any one of the stock bobbins 4. In accordance with the illustration a distributor mechanism 22 movable along a guideway 19 may be provided with a belt conveyor adjustable between a number of takeover positions, each associated with one of the conveyor belts 21, and a transfer position associated with the charging station 11.

During a weaving operation with only a few different kinds of yarn, the distributor mechanism 22 may be controlled according to a predetermined program, say, to correspond with the distribution of bobbins prevailing at the time in the weaving shed, in such a way that the stock bobbins needed at any time for one of the groups of looms 1*a*, 1*b* . . . 1*n* are fed to the charging station 11 in a combination of the kinds of yarn corresponding with the program, in which the bobbin holders 12 are each charged with one of the stock bobbins 4 docked on one of the carriers 28 lying in the transport loop 7. If necessary the bobbin holders 12 may also be provided in the charging station 11 with the "code" corresponding with the kind of yarn, by which if necessary the track of each bobbin may be followed as far as the loom. In the case where a number of different kinds of yarn are used, in particular in the case of multicolour weaving operation, the distributor mechanism 22 as indicated in FIG. 1 may also be connected via a control equipment (not shown) to the central master computer 23 monitoring the production and, say, be controlled to correspond with the immediate need of bobbins by one of the groups of looms 1*a*, 1*b* . . . 1*n* which is to be loaded at the time. The detection group by group of the relatively easily determinable need of bobbins by the individual groups of looms 1*a*, 1*b* . . . 1*n* enables a relatively simple control of the loading processes.

According to the representation according to FIG. 1, for each of the groups of looms 1*a*, 1*b* . . . 1*n* ten stock bobbins 4 are provided, the bobbin holders 12 of which are fastened into a coherent bobbin train on the carriers 28 combined into one transport unit 30. A greater number of stock bobbins 4 may also be combined into one bobbin train which may extend substantially across the whole width of the weaving shed. In the example shown it may be assumed that five stock bobbins 4 are wound with a first kind of yarn A, three stock bobbins 4 with a second kind of yarn B and two stock bobbins 4 with a third kind of yarn C. The charged bobbin holders 12 are carried at any time in accordance with the arrow 27 via the feed section 7*a* towards the junction section 8 in which the bobbin train may be introduced into the mounting 20 when the latter adopts the transfer position shown in FIG. 1. Further correspondingly assembled transport units 30 may in accordance with the illustration be stored in the storage sections 7*c* and carried out of them at any time as needed, via the junction sections 8 or 8' into the mounting 20.

The stock bobbins 4 lying in the mounting 20 are brought by the bearer rail 16 which may be moved according to the arrows 25, into a transfer position provided above one of the alleyways, in which the bobbin holder 12 with the stock bobbins 4 which correspond with the need of a bobbin determined for one of the looms 2 is removed by the loading mechanism 18 from the bobbin train, fed to the bobbin frame 3 of the loom 2 in question and there exchanged for a bobbin holder 12' with an empty bobbin tube 4'. Through the master computer 23 it may be established whether during running out of the weft yarn from the stock bobbin 4 as detected by a corresponding sensor, it is a question of a process to be expected operationally or of a yarn breakage. A bobbin holder 12' with a defective stock bobbin 4 which, e.g., has been wound in a faulty manner or with yarn tending to yarn breakages, may accordingly at any time also be replaced by a bobbin holder 12 with a fresh stock bobbin 4. Thus a spent stock bobbin may either be an empty bobbin tube or a defective stock bobbin. The bobbin holder 12' is hereupon fastened to the free carrier 28 situated on the mounting 20.

When the empty bobbin tubes 4' of all of the looms 2 of the group of looms in question, e.g., 1*a* have been replaced by fresh stock bobbins 4, or if under certain circumstances a stock bobbin 4 with a kind of yarn needed in the group of looms in question is lacking in the bobbin train, the bearer rail 16 is run back into one of the transfer positions associated with the junction sections 8, 8' from which the transport unit 30' now consisting of the bobbin holders 12' for the bobbin tubes 4' as well, possibly, as one or more bobbin holders 12 with stock bobbins 4 which have not been used, is returned via the return section 7*b* towards the preparation station 5. Hereupon a further transport unit 30 fully charged with stock bobbins is brought out of one of the storage sections 7*c* via the junction sections 8 or 8' into the mounting 20 which is again brought into the transfer position associated with the incompletely loaded group of looms 1*a* and/or into a transfer position associated with another group of looms, e.g., 1*b* in which the needed stock bobbins 4 may be fed in the way described to the looms 2 of the group of looms concerned, 1*a* or 1*b* . . . 1*n* respectively, and the empty bobbin tubes 4' be taken away.

The bobbin holders 12', which in the meantime have been returned to the preparation station 5, are removed from their carriers 28, freed of the bobbin tubes 4' in the discharging station 13 and fed to the charging station 11 in which as bobbin holders 12 they are recharged with stock bobbins 4, each provided with the code corresponding with the kind of yarn and docked on the respective carrier 28 of the transport loop 7. The bobbin train charged with the foreseen combination of kinds of yarn is hereupon led in the way described into the feed section 7*a* or into one of the storage sections 7*c*.

In the further Figures corresponding parts are designated by the same reference numbers.

Figure 2:
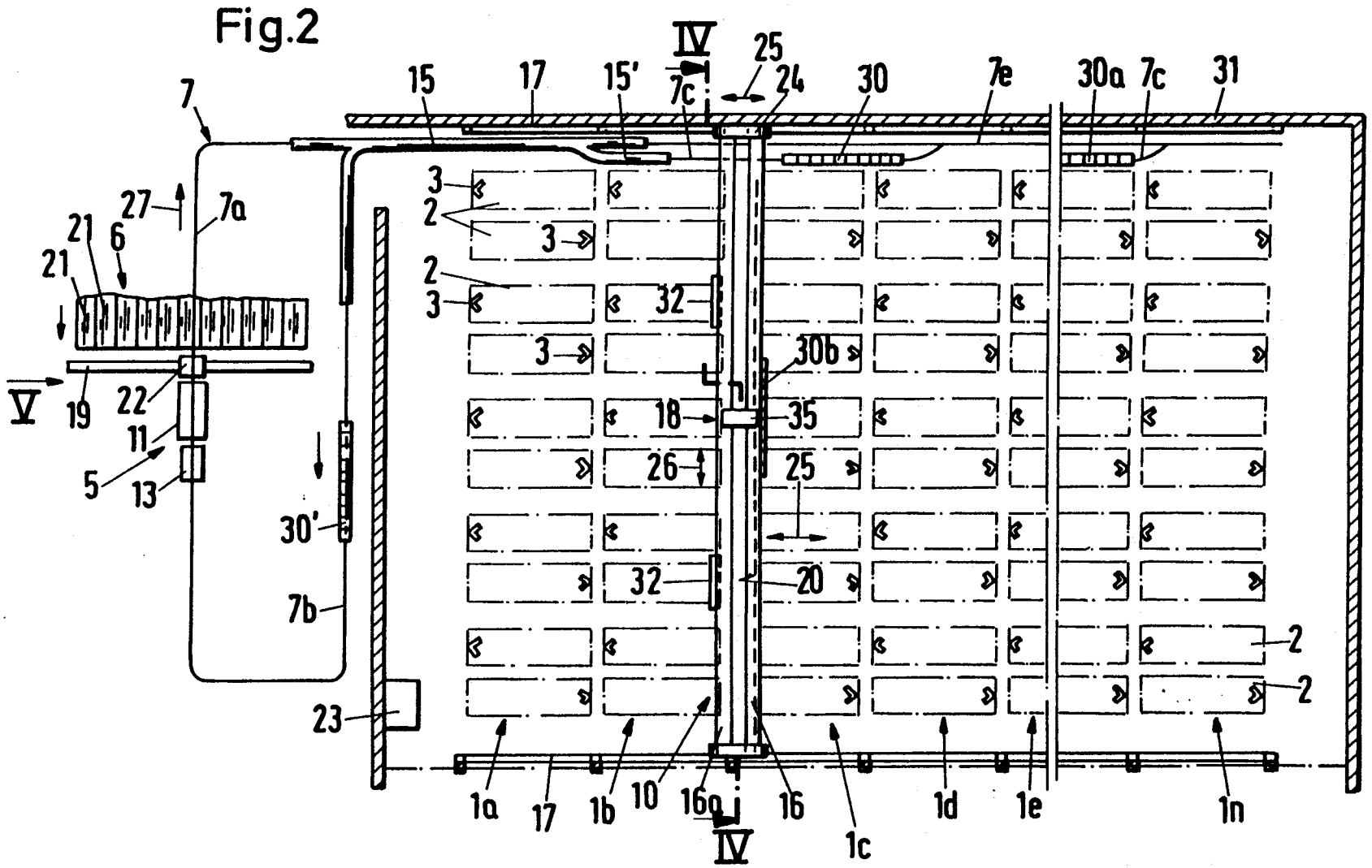
FIGS. 2 and 3 are partial plan views of a loom installation with further equipment developed in accordance with the invention, each in another embodiment.

FIG. 2 shows one part of a weaving shed with groups of looms 1*a*, 1*b*, 1*c*, 1*d*, . . . 1*n*, which in accordance with the illustration comprise ten looms 2 each.

The looms 2 are arranged in known manner so that within each group 1*a*, 1*b* . . . 1*n* the warp beams or respectively the cloth beams of two adjacent looms 2 are next to one another and accordingly the bobbin frames 3 are arranged on those narrow sides of adjacent areas which are remote from one another. In the case of this embodiment the transport loop 7 is connected to a transport section 7*e* which extends along one side wall 31 of the weaving shed over substantially its whole length and from which a number—two as illustrated—of storage sections 7*c* running in parallel with it may branch off for receiving two transport units 30 and 30*a*. The transport mechanism 10 comprises a crane beam with two bearer rails 16 and 16*a* upon which the loading mechanism 18 arranged between them is guided to be able to shift. As appears in particular from FIG. 4 the mounting 20 intended for receiving the transport unit 30 is fitted to the bearer rail 16. On the bearer rail 16*a* further auxiliary devices —in accordance with the illustration sets 32 of pneumatic cleaning devices—may be provided which in known manner may be provided with suction lines 33 which may be carried in the longitudinal direction (arrows 25) over any one of the looms 2 lying in its range of movement, for cleaning the loom 2 in question. On the bearer rail 16*a* a number of stationary sets 32 may be provided, each associated with one of the rows of looms extending in the longitudinal direction, by which at any time all of the looms 2 of one group of looms 1*a*–1*n* may be cleaned at the same time. In FIG. 2 two sets 32 are shown, which according to the arrows 26 may be positioned over any one of the rows of looms. The control of the cleaning devices may usefully be made such that in the event of a change of a bobbin being necessary any cleaning process happening at the time is interrupted and continued only after completion of the change of bobbin. Standstill times of the loom are accordingly avoided.

As further appears from FIG. 4, the loading mechanism 18 comprises a driving unit 34 which is mounted on a crab 35 guided on the bearer rails 16, 16*a*, and a manipulator arm 36 like a toggle lever, which comprises a first lever 37 hinged pivotally to the driving unit 34 and a second lever 38 hinged to the first. The levers 37 and 38 may be swung by the driving unit 34 between a transfer position 36' indicated in dash-dot line, associated with the mounting 20, and the extended loading position shown, associated with the bobbin frame 3 of one of the looms 2 to be loaded at the time. At the free end of it the second, lever 38 is provided with a gripper 40 for seizing, removing, inserting and releasing any one of the bobbin holders 12 or 12'. This execution yields a precise positionable loading mechanism of compact construction and having a wide range of movement and allows an exchange of the bobbin holders 12' and 12 without impairment worth mentioning of other automated auxiliary devices. The manipulator arm 36 enables the "encompassing" of obstacles which possibly exist in the range of movement of the loading mechanism, e.g., a carrier 41 indicated in FIG. 8 for a cleaning set which is not shown.

The transport units 30 and 30*a* loaded in the preparation station 5 are carried in the way described into the storage sections 7*c*. In the position of the transport mechanism 10 represented in FIG. 2 the transport unit 30 is being introduced into the mounting 20 in which, e.g., by positionable stops, it may be held in a definite position 30*b*—or in a number of corresponding positions. To correspond with the need of bobbins reported via the control computer 23, the transport mechanism 10 is brought into a transfer position associated with the groups of looms 1*a* to 1*n* or held, if necessary, in the transfer position shown above the alleyway running between the groups of looms 1*b* and 1*c*. Via the correspondingly controlled loading mechanism 18, the coded bobbin holder 12 required at the time is removed in the way described from the bobbin train, fed to the proper bobbin frame 3 lying in the alleyway concerned in the group of looms 1*b* or 1*c* and exchanged for the bobbin holder 12' which is to be exchanged and which is subsequently returned to the corresponding gap in the bobbin train and fastened to the mounting 20.

The bobbin holders 12' loaded with the bobbin tubes 4' are hereupon returned as the transport unit 30' via one of the storage sections 7*c* to the preparation station 5. Then another transport unit 30 or 30*a* may be introduced into the mounting 20 from the storage section 7*c* concerned.

Figure 3:
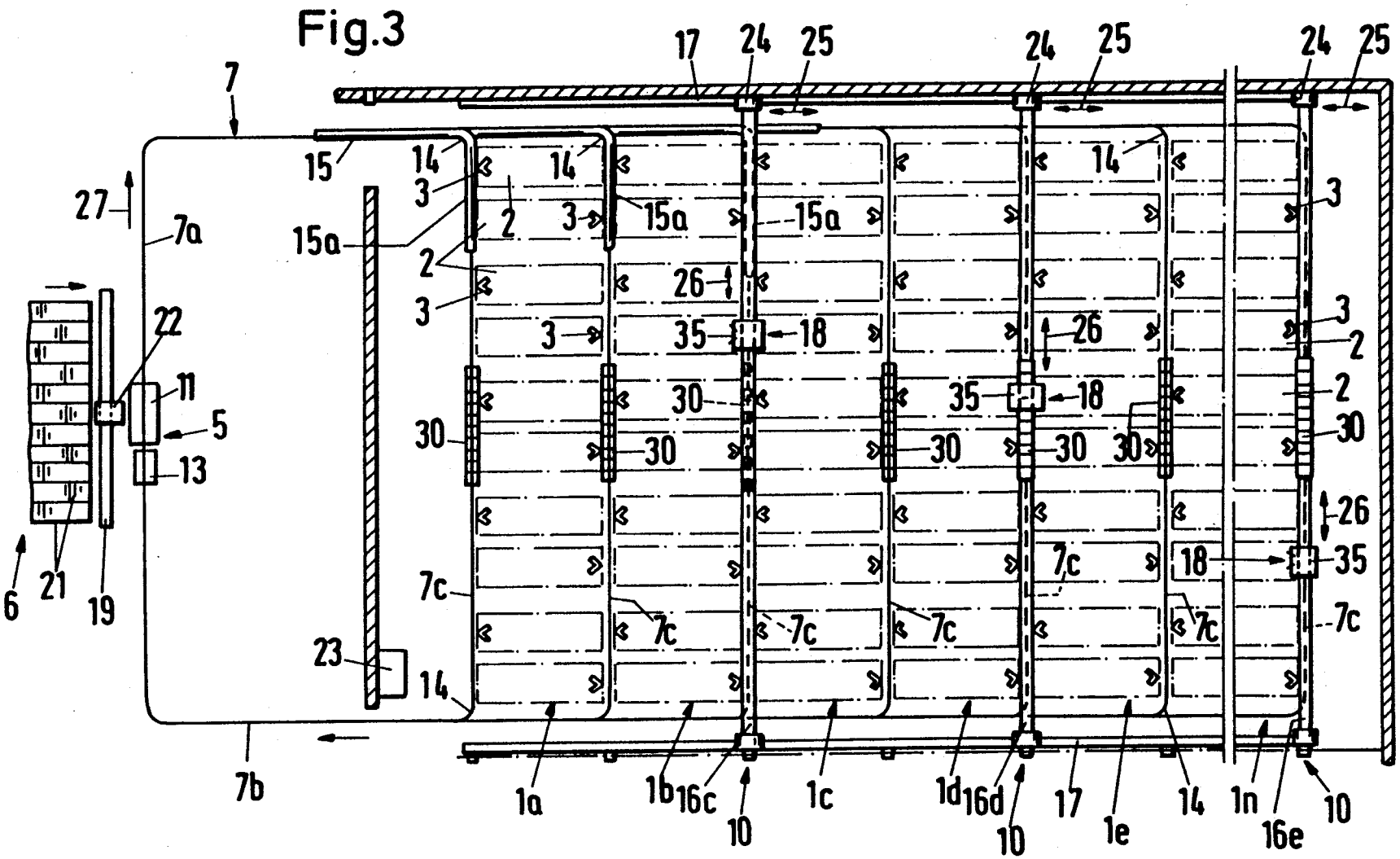

In the case of the execution according to FIG. 3 the transport loop 7 extends over the whole length of the weaving shed and exhibits, branching off it, a number of storage sections 7*c*. Each storage section may be associated with an alleyways running between the groups of looms 1*a* to 1*n* as well as one to each of the two end rows of bobbin frames 3 of the groups of looms 1*a* and 1*n* respectively, each of the storage sections being able to receive one transport unit 30. With this execution the storage sections 7*c* may be constructed on guiderails 15*a* which are arranged stationary, each running over at least part of the width of the weaving shed, and which may be connected via points 14 to the guiderails 15 of the feed section 7*a* and the return section 7*b*. A number of bearer rails 16*c*, 16*d*, 16*e*—three as illustrated—may further be provided, which are arranged distributed over the length of the weaving shed. The bearer rails lie above the system of guiderails 15 and 15*a* and are carried on the guideways 17 to be able to shift, each over a certain portion of the length of the weaving shed. In accordance with FIG. 3 the bearer rail 16*c* is intended for loading the groups of looms 1*a*, 1*b*, 1*c* and the bobbin frames 3 next to them on the group of looms 1*d*, while the bearer rails 16*d* and 16*e* are provided for loading the groups of looms 1*e* to 1*n* and the bobbin frames 3 next to them on the group of looms 1*d*.

It is obvious that also in the case of the executions according to FIGS. 1 and 2 a number of corresponding bearer rails 1*a*, 1*b*, 1*c* may be provided through which at any time a number of groups or pairs of groups of looms may be loaded with stock bobbins 4. Thus, in accordance with FIG. 3, the bearer rails 16*c*, 16*d*, and 16*e* are brought into the corresponding transfer positions in which the loading mechanisms 18 remove the bobbin holders 12 determined by the master computer, with the stock bobbins 4, from the associated transport units 30 and feed each to the bobbin frame 3 concerned, exchanging them for the bobbin holders 12' containing the bobbin tubes 4'.

Instead of displaceable bearer rails 16, 16*a*–16*c* like crane beams, stationary bearer rails arranged in accordance with FIG. 3, e.g., above the guide rails 15 but not shown, may also be provided for guidance of the loading mechanisms 18. These bearer rails may be able to be coupled group by group to connecting rails (not shown) running in the longitudinal direction, which allow a changeover of the loading mechanism 18 associated with this group from one bearer rail to the other.

In accordance with FIG. 5 the charging station 11 may include a bracket 51 which is arranged to be able to shift on a vertical beam 50 and is adjustable between a lower position shown in solid line and an upper position 51' shown in dash-dot line, in which any one of the bobbin holders 12' may be seized. The bobbin holder 12' is released from the carrier 28 and lowered by the bracket 51 being moved into the lower position. At the lower position the bobbin tube 4' is pulled off and carried away by a removal device 52 not shown in detail, into a container at the discharge station 13. The empty bobbin holder 12 is then carried by the bracket 51 towards the stock bobbin 4 which has been fed in via the distributor equipment 22 and may be seized in the region of a preparation unit 53 in the charging station 11 and brought together with a suction device 54 for releasing and preparing the piece 55*a* at the start of the weft yarn if and, necessary, the piece 55*b* at the end of the weft yarn 55 wound onto the stock bobbin 4.

The piece 55*a* at the start and the piece 55*b* at the end of the weft yarn may be transferred by guide means (not shown) to a yarn guide part 47 provided on the bobbin holder 12, which in a predetermined operating position of the bobbin holder 12 on the loom 2, may be brought together with a device on the side of the loom, e.g., a suction nozzle (not shown) for transfer of the starting-piece 55*a*. In that case if necessary a connection of the piece 55*a* at the start of the standby bobbin to the piece 55*b* at the end of the active bobbin and thereby the relatively laborious preparation of the end-piece 56*b*may be waived. This method enables automation of the change of bobbin and the transfer of yarn to the weft insertion equipment on the loom. The yarn guide part 47 may exhibit two clamps 48 and 49 each positionable with respect to a transfer position predetermined on the bobbin frame 3, for securing and releasing the starting-piece 55*a* or the end-piece 55*b*.

Upon raising the bracket 51 again, the bobbin holder 12 is finally docked on the carrier 28. The bobbin holder 12 is then transported onwards and the next bobbin holder 12' is mounted on the bracket 51.

In contrast to the execution according to FIG. 5, in which the stock bobbins 4 are transported with vertical axes, in the case of the embodiment according to FIGS.

6 and 7 carriers 57 may be provided for receiving the bobbin holders 12 and 12' on which the stock bobbins 4 and the bobbin tubes 4', respectively, are arranged with approximately horizontal axes 58. The charging station 11 contains a slide-in mechanism 60 by which the bracket 51, together with the bobbin holder 12, may in its upper position 51' be tilted by about 90° and the bobbin holder 12 be held with approximately horizontal axis 58 and docked on the respective carrier 57. The bobbin holders 12' may then be taken off the carriers 57 in a discharging station which is not shown, freed of the bobbin tubes 4' and, in accordance with FIG. 6, fed to the charging station 11 via a conveyor belt 61.

According to another embodiment (not shown) corresponding bobbin holders 12 and 12' can also be provided each for receiving two or several stock bobbins 4 and bobbin tubes 4', respectively, arranged side by side or one upon another.

Instead of the automatic charging station 11 a manual charging station may also be provided. The stock bobbins 4 are pre-sorted to correspond with the need of bobbins and fed in predetermined sequence are respectively prepared and mounted by an operator on the bobbin holders 12 which are already assembled into the transport unit 30, and then fed via one of the storage sections 7c of the transport mechanism 10 in the way described. As indicated in FIG. 8 the removal mechanism 52 for removing the bobbin tube 4' and the preparation unit 53 for seizing and laying ready the starting-piece and if necessary the end-piece of the weft yarn, may in this case be fitted together with the loading mechanism 18 onto the transport mechanism 10 so as to be able to shift along the bearer rail 16.

Figure 9:
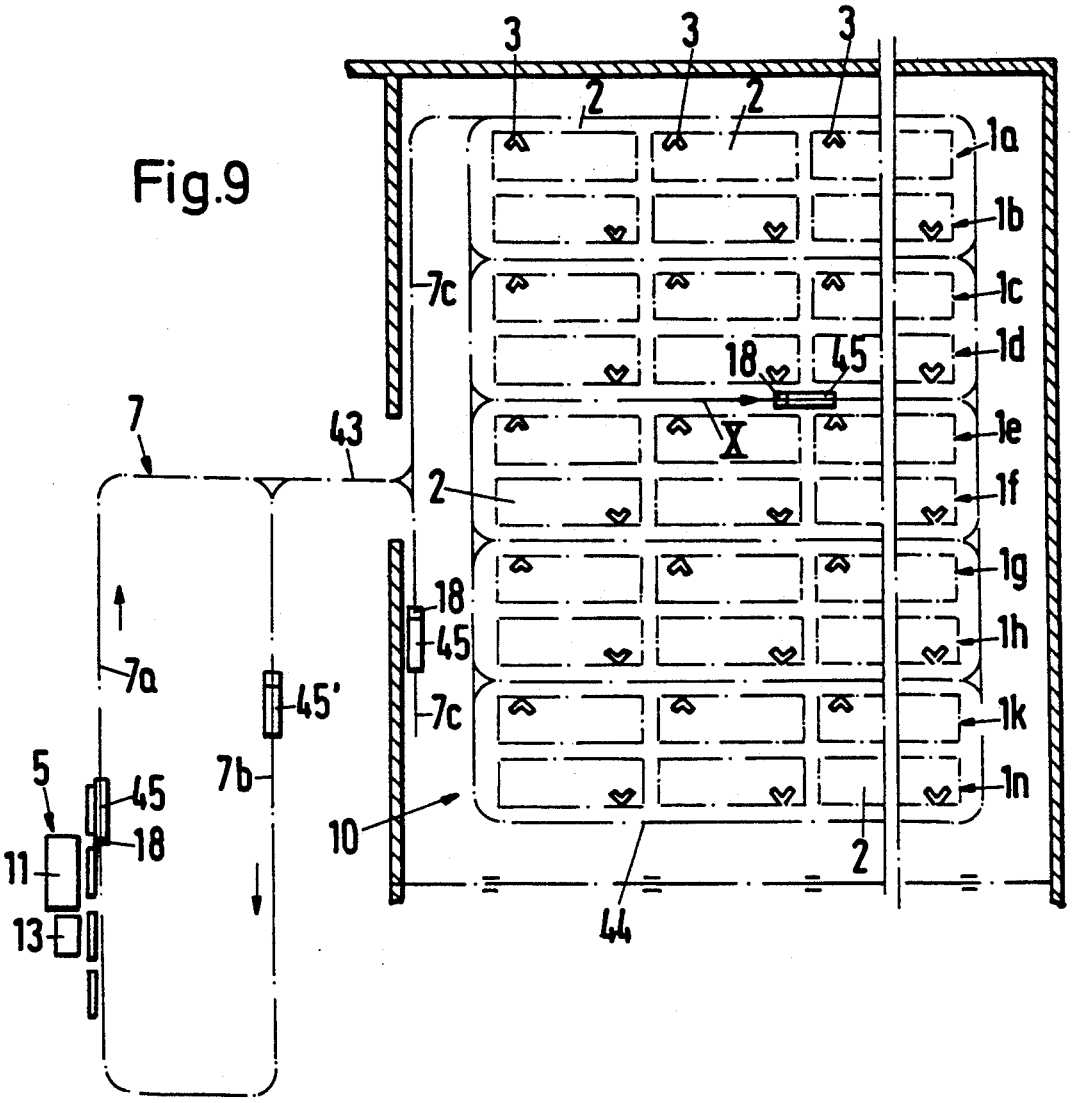
FIG. 9 is a partial plan of a loom installation in a further embodiment.
Figure 10:
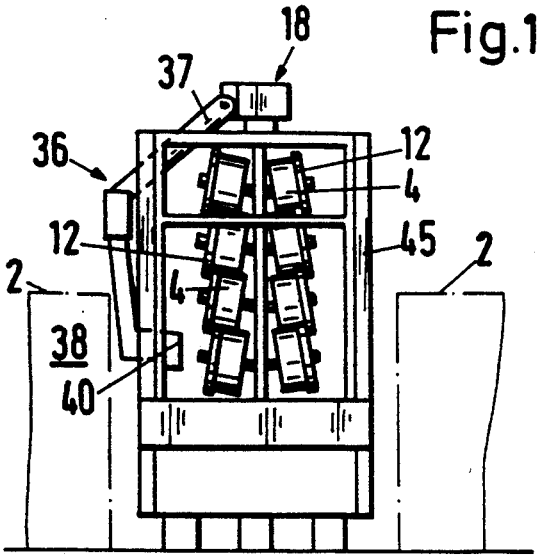
FIG. 10 is a detail of the equipment according to FIG. 9 in a side elevation in accordance with the arrow 10 in FIG. 9.

To correspond with the illustration according to FIGS. 9 and 10 the transport loop 7 and the secondary transport mechanism 10 may each have, provided in the floor, an induction loop 43 and 44 respectively which are suitable for the guidance of transport trucks 45 chargeable with the bobbin holders 12 or 12'. The induction loops are connected together via the storage section 7c. The bobbin holders 12 and 12' may also be mounted on a trailer (not shown) which may be coupled to the transport truck 45. In accordance with FIG. 9, the bobbin frames 3 of the looms 2 may be arranged to be accessible from one side, the warp side as illustrated. In each case one portion of the induction loop 44 of the transport mechanism 10, upon which the transport truck 45 is guided, runs through the warp alleyways which run between the warp beams facing one another. The transport truck 45 may be fitted with the loading mechanism 18 by which the bobbin frames 3 of the groups of looms 1a, 1b, 1c . . . 1n—separated in the case of the arrangement shown, by the warp and weaver alley-ways running in the longitudinal direction - may in each case be charged from the warp side with bobbin holders 12 containing the stock bobbins 4 and relieved of bobbin holders 12' containing the bobbin tubes 4'.

Upon running the transport trucks 45 and/or the corresponding trailers through the preparation station 5 the bobbin holders 12' may, in the unloading station 13, be freed automatically or by hand of the bobbin tubes 4', and be charged in the charging station 11—likewise by hand or automatically—with the stock bobbins 4 selected to correspond with the established need of bobbins, and mounted on the transport truck 45 or on the trailer. The transport truck 45 or trailer is then put away in the storage section 7c and at need - say, if the transport truck 45 shown between the groups of looms 1d and 1e has completed the charging process and is being returned via the return section 7b towards the preparation station 5—is fed from it along the induction loop 44 to the next group of looms which has to be loaded or respectively to the pair of groups which has to be loaded, e.g., 1f and 1g.

Hence in the case of this execution too the transport loop 7 of the transport mechanism 10 performing the fine distribution in the weaving shed is functionally separated and can therefore be operated independently of the loading process.

We claim:

1. An equipment for transporting, handling and feeding stock bobbins to a loom and for carrying away a spent stock bobbin from the loom, the equipment comprising:

a loading station having means for loading the stock bobbin on a bobbin holder;

a transport loop having means for carrying the bobbin holder between the loading station and a number of groups of looms, the transport loop having a portion adapted to deliver the bobbin holder to the number of groups of looms, the transport loop also having a storage section connected to the portion of the transport loop and constructed to receive a number of the bobbin holders; and a secondary transport mechanism arranged to receive the bobbin holder from the transport loop, the secondary transport mechanism including a loading mechanism having means for positioning the loading mechanism at a loading position with respect to each loom in the number of groups of looms and means for replacing the spent bobbin with the stock bobbin when in the loading position.

2. An equipment for transporting, handling and feeding stock bobbins to a loom and for carrying away a spent stock bobbin from the loom, the equipment comprising:

a loading station having means for loading the stock bobbin on a bobbin holder;

a transport loop connected to the loading station and adapted to be connected to the loom and having means for carrying the bobbin holder between the loading station and the loom, the transport loop having a portion adapted to deliver the stock bobbin to a number of looms, the transport loop also having a storage section connected to the portion of the transport loop and constructed to receive a number of the bobbin holders;

a secondary transport mechanism arranged to receive the bobbin holder from the transport loop, the secondary transport mechanism including a loading mechanism having means for replacing the spent bobbin with the stock bobbin and means for positioning the loading mechanism at a loading position with respect to the loom for loading the stock bobbin to the loom; and a master computer having means for detecting a stock bobbin requirement of the loom, the master computer being operatively coupled to the secondary transport mechanism and the loading mechanism so that the secondary transport mechanism and the loading mechanism are brought to the loading position corresponding with the stock bobbin requirement of the loom.

3. An equipment for transporting, handling and feeding stock bobbins to a loom and for carrying away a spent stock bobbin from the loom, the equipment comprising:

a loading station having means for loading the stock bobbin on a bobbin holder, including a guide member configured to seize a piece at the start of the weft yarn on the stock bobbin, the bobbin holder being movable into a predetermined operating position of the bobbin holder;

a transport loop connected to the loading station and adapted to be connected to the loom and having means for carrying the bobbin holder between the loading station and the loom, the transport loop having a portion adapted to deliver the stock bobbin to a number of looms, the transport loop also having a storage section connected to the portion of the transport loop and constructed to receive a number of the bobbin holders;

a secondary transport mechanism arranged to receive the bobbin holder from the transport loop, the secondary transport mechanism including a loading mechanism having means for replacing the spent bobbin with the stock bobbin and means for positioning the loading mechanism at a loading position with respect to the loom for loading the stock bobbin to the loom;

whereby the loom can receive the piece at the start of the weft yarn when the bobbin holder is in the predetermined operating position.

4. The equipment of claim 1 wherein:

the loading mechanism includes a driving unit, carried by the transport mechanism, and a manipulator arm having a first lever pivotally connected to the driving unit and a second lever pivotally connected to the first lever, the driving unit being operatively coupled to the first and second levers for movement between a transfer position, associated with the transport mechanism, and the loading position, adapted to be associated with a bobbin zone of at least one of the looms in the number of groups of looms, the second lever having means for seizing and releasing the bobbin holder.

5. An equipment for transporting, handling and feeding stock bobbins to a loom and for carrying away a spent stock bobbin from the loom, the equipment comprising:

a loading station having means for loading the stock bobbin on a bobbin holder;

a transport loop connected to the loading station and adapted to be connected to the loom and having means for carrying the bobbin holder between the loading station and the loom, the transport loop having a portion adapted to deliver the stock bobbin to a number of looms, the transport loop also having a storage section connected to the portion of the transport loop and constructed to receive a number of the bobbin holders, the transport loop being formed as a conveyor having guiderails arranged at a height above a floor; and a secondary transport mechanism arranged to receive the bobbin holder from the transport loop, the secondary transport mechanism including a loading mechanism having means for replacing the spent bobbin with the stock bobbin and means for positioning the loading mechanism at a loading position with respect to the loom for loading the stock bobbin to the loom, the storage section being formed by a piece of guiderail configured to receive a predetermined number of bobbin holders.

6. The equipment of claim 5 wherein the piece of guiderail is connected to the portion of the transport section.

7. The equipment of claim 1 wherein:

the secondary transport mechanism further comprises a supporting structure adapted to be moved between the number of groups of looms, the number of groups of looms being arranged in a row, the secondary transport mechanism having a bearer rail extending parallel to the number of groups of looms and a mounting formed by a further piece of guiderail extending parallel to the bearer rail, the mounting being configured to carry the bobbin holder; and the loading mechanism being mounted to the bearer rail and having means for moving along a length of the bearer rail.

8. A method for transporting, handling and feeding a stock bobbin to a loom and for carrying a spent bobbin away from the loom, the method including the steps of:

charging a predetermined number of bobbin holders with stock bobbins at a preparation station corresponding with a bobbin need of a group of looms;

combining the predetermined number of bobbin holders into a transport unit;

transporting the transport unit via a transport loop into a storage position;

moving a secondary transport mechanism into a transfer position associated with the storage portion;

bringing the secondary transport mechanism into a transfer position associated with the group of looms;

intermittently bringing a loading mechanism associated with the secondary transport mechanism into a loading position which corresponds with an individual bobbin need of an individual loom in the group of looms, the loading mechanism being adapted to move into the loading position with respect to each loom in the group of looms;

exchanging a bobbin holder having the stock bobbin for a spent bobbin associated with the individual loom;

carrying the spent bobbin into the storage section;

returning the spent bobbin via the transport loop to the preparation station; and recharging the bobbin holder having the spent bobbin with a fresh stock bobbin to correspond with a further bobbin need of a further group of looms.

* * * * *